US010059497B2

(12) United States Patent
Rehberg et al.

(10) Patent No.: US 10,059,497 B2
(45) Date of Patent: Aug. 28, 2018

(54) PRODUCT HANG CARD FOR RETAIL DISPLAY

(71) Applicant: TARGET BRANDS, INC., Minneapolis, MN (US)

(72) Inventors: Adam Rehberg, Minneapolis, MN (US); Timothy Michael Magner, Champlin, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 361 days.

(21) Appl. No.: 14/977,091

(22) Filed: Dec. 21, 2015

(65) Prior Publication Data

US 2017/0174406 A1 Jun. 22, 2017

(51) Int. Cl.
*B65D 73/00* (2006.01)

(52) U.S. Cl.
CPC ..... *B65D 73/0064* (2013.01); *B65D 73/0014* (2013.01)

(58) Field of Classification Search
CPC ..... B65D 73/0014; B65D 73/0064
USPC ..... 206/320, 461, 471, 495, 806
See application file for complete search history.

(56) References Cited

U.S. PATENT DOCUMENTS 2,958,446 A 11/1960 Teague
3,086,309 A 4/1963 Katz
3,329,386 A * 7/1967 Rosen ..... B65D 85/18 206/299
4,190,151 A * 2/1980 Russell ..... B65D 73/0071 206/281
4,257,522 A * 3/1981 Thorneburg ..... B65D 85/18 206/299
4,346,825 A 8/1982 Leger
4,678,079 A * 7/1987 Henning ..... B65D 85/18 206/279
4,805,816 A 2/1989 Freund
4,887,709 A 12/1989 Shimamine
5,469,959 A * 11/1995 Gummer ..... B65D 73/0078 206/299
5,522,499 A * 6/1996 DeBiasio ..... B65D 85/18 206/278
D377,868 S 2/1997 Charlet
(Continued)

OTHER PUBLICATIONS

Phone Case Package used in public retail displays more than one year prior to Dec. 21, 2015 (1 page).

*Primary Examiner* — Luan K Bui
(74) *Attorney, Agent, or Firm* — JoAnn M. Seaton; Griffiths & Seaton PLLC

(57) ABSTRACT

A packaged mobile device accessory includes a mobile device accessory and a hang card. The mobile device accessory includes a back wall, a top wall, at least two opposing sidewalls, and first and second flanges. Each of the first and second flanges extends from one of the at least two opposing sidewalls to form one of a first side pocket and a second side pocket. The hang card includes a primary panel, two card sidewalls, and a hook panel. The card sidewalls each extend from the primary panel. Each of the card sidewalls is maintained within one of the first and second side pockets of the mobile device accessory. The hook panel extends upwardly from the primary panel and includes a cutout to receive a supporting structure above the top wall of the mobile device accessory such that the packaged mobile device is configured to hang from the supporting structure.

20 Claims, 13 Drawing Sheets

(56) References Cited

U.S. PATENT DOCUMENTS

| | | | | |
|---|---|---|---|---|
| D421,568 | S | 3/2000 | Ferguson et al. | |
| 6,651,810 | B2 | 11/2003 | Nichol, Jr. | |
| 7,000,774 | B2 | 2/2006 | Bryant | |
| 7,178,712 | B2 * | 2/2007 | Schultz | B65D 5/4208 206/806 |
| 7,374,070 | B2 | 5/2008 | Dikes | |
| 7,540,377 | B1 | 6/2009 | Krisher | |
| D611,805 | S | 3/2010 | Barniquel | |
| 7,931,148 | B2 | 4/2011 | Hansen et al. | |
| D681,444 | S | 5/2013 | Oja et al. | |
| 8,616,373 | B2 | 12/2013 | Hansen et al. | |
| 2002/0130055 | A1 | 9/2002 | Morrison, Jr. | |
| 2006/0060481 | A1 * | 3/2006 | Hartman | B65D 73/0078 206/305 |
| 2012/0012489 | A1 | 1/2012 | Mongan et al. | |
| 2013/0292281 | A1 * | 11/2013 | Chung | H04B 1/3888 206/320 |

* cited by examiner

PRODUCT HANG CARD FOR RETAIL DISPLAY

BACKGROUND OF THE INVENTION

As cell phones and other mobile devices continue to increase in popularity, the demand for accessories available for use therewith also continues to rise. Accordingly, retail assortments of mobile device accessories have also grown and continue to grow. Typical packaging for mobile accessories being offered for sale includes boxes or clamshells, which often substantially enclose an entirety of the accessory.

While mobile device accessory packaging may include an open window or access port for directly viewing and or physically touching the accessory, such windows do not allow a potential consumer to fully assess how an accessory will feel in his or her hand, how the size of the accessory will translate to its end use, and/or other features of the mobile device accessory that may be of importance to a consumers decision whether or not to purchase a mobile device accessory. The consumers' desire to have full tactile and visual assess to a mobile device accessory is offset by a retailer's desire to have the same mobile device accessory be reliably and securely supported in a retail display while occupying as small a retail display space as possible. In addition, retailers also generally would like sufficient open space on the packaging for visually presenting marketing, product information, and/or for facilitating product sale processing of the mobile device accessories at a retail point-of-sale terminal.

SUMMARY

A packaged mobile device accessory includes a mobile device accessory and a hang card. The mobile device accessory includes a back wall, a top wall, at least two opposing sidewalls, and first and second flanges. Each of the first and second flanges extends from one of the at least two opposing sidewalls opposite the back wall to form a corresponding one of a first side pocket and a second side pocket. The hang card includes a primary panel, two card sidewalls, and a hook panel. The primary panel is positioned adjacent the back wall and defines two opposing side edges and a top edge. The two card sidewalls each extend from a different one of the two opposing side edges of the primary panel. Each of the two card sidewalls is maintained within a different one of the first side pocket and the second side pocket of the mobile device accessory. The hook panel extends upwardly from the top edge of the primary panel and above the top wall of the mobile device accessory and includes a hook cutout to receive a supporting structure above the top wall of the mobile device accessory such that the packaged mobile device is configured to hang from the supporting structure. Other packaged mobile device accessories, hang cards, and associated methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" apply to all numeric values or descriptive terms, respectively, and generally indicate a range of numbers or characteristics that one of skill in the art would consider equivalent to the recited values or terms, that is, having the same function or results.

This innovation provides a hang card for supporting a mobile device accessory, such as a case or skin, for retail sale. The hang card includes a primary panel and side panels, which have back and side dimensions substantially identical to corresponding dimensions of a mobile device, which is sized to fit snuggly within the mobile device accessory, for example, via compression and/or friction fit. The hang card incorporates a dual-layer hanger portion to provide a substantially robust mechanism for hanging the hang card and an associated mobile device case from a retail display support rod. In one embodiment, the hang card is further coupled with the mobile device accessory via an additional securement method, such as a plastic tie or other suitable device. The hang card and mobile device accessory assembly collectively define a packaged mobile device accessory that is generally easily held and more fully able to be examined by a consumer, as compared to prior art packaged mobile device accessories. In one example, a consumer is able to hold the mobile device accessory in his or her hand, as part of a packaged mobile device accessory, with little or no interference from hang card allowing the consumer to be better able to fully assess whether the mobile device accessory suits their needs and/or preferences. In addition, hang cards as described herein each add nothing or very little to the overall footprint dimensions of the mobile device accessory such that retail space need to display packaged mobile device accessory is greatly decreased as compared to prior packaging options.

Figure 1:
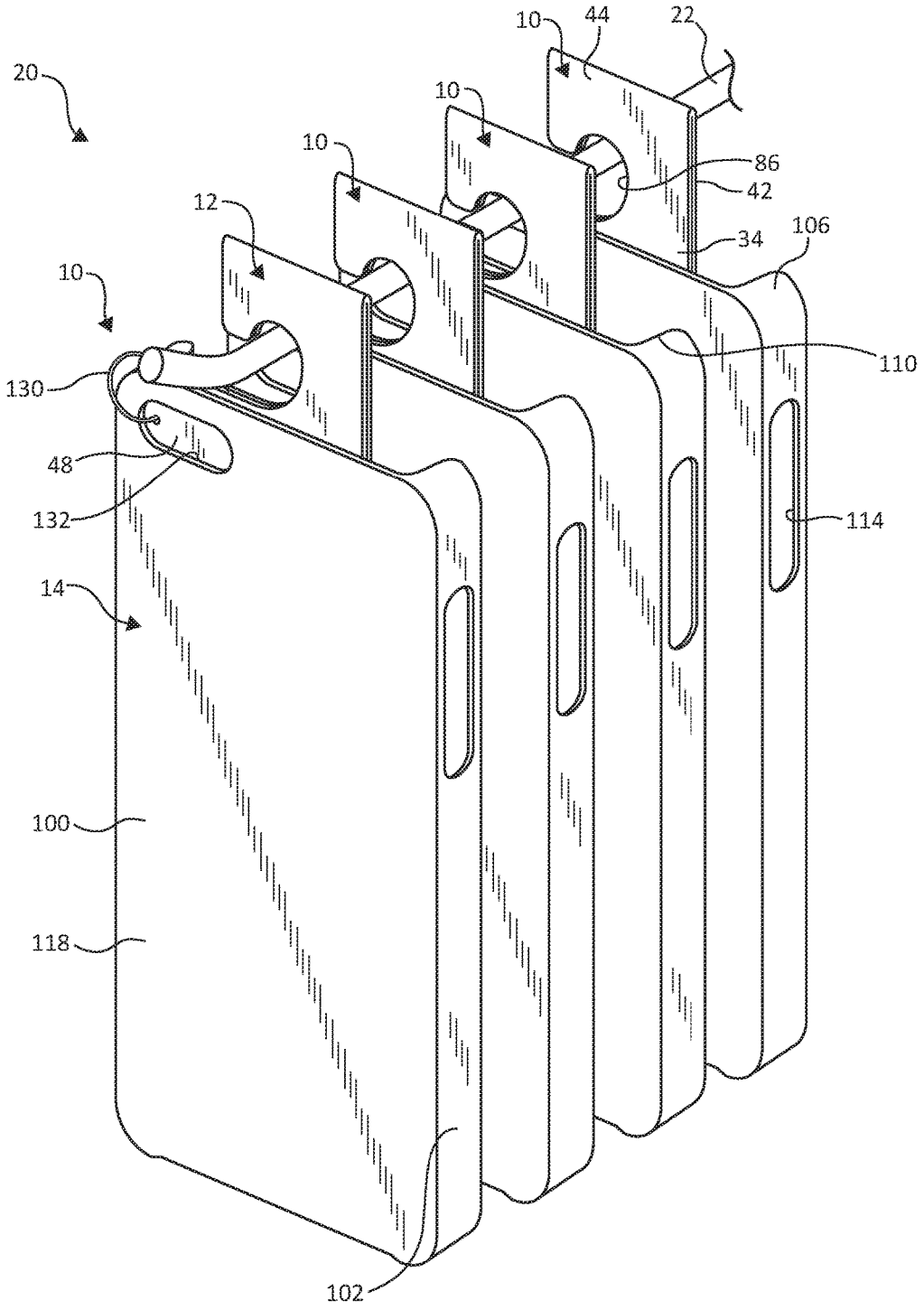
FIG. 1 is a front perspective view illustration of a plurality of hang cards each supporting a different mobile device accessory as part of a retail display, according to one embodiment of the present invention.

Turning to the Figures, FIG. 1 illustrates a plurality of packaged mobile device accessories 10 including a hang card 12 and a mobile device accessory 14, such as a mobile device case, which as used herein includes mobile device skins, for a mobile device such as an MP3 player, mobile phone, electronic tablet, GPS unit, etc. Each packaged mobile device accessory 10 is configured to hang in a retail display 20 from a support arm 21 or other suitable display support, according to one embodiment of the present invention. In this manner, each mobile device accessory 14 is individually supported by a separate hang card 12 such that each mobile device accessory 14 can be grasped, touched, hand held, and otherwise fully examined by a consumer to aid their decision making process in deciding whether to purchase a particular one of the mobile device accessories 14.

Figure 2:
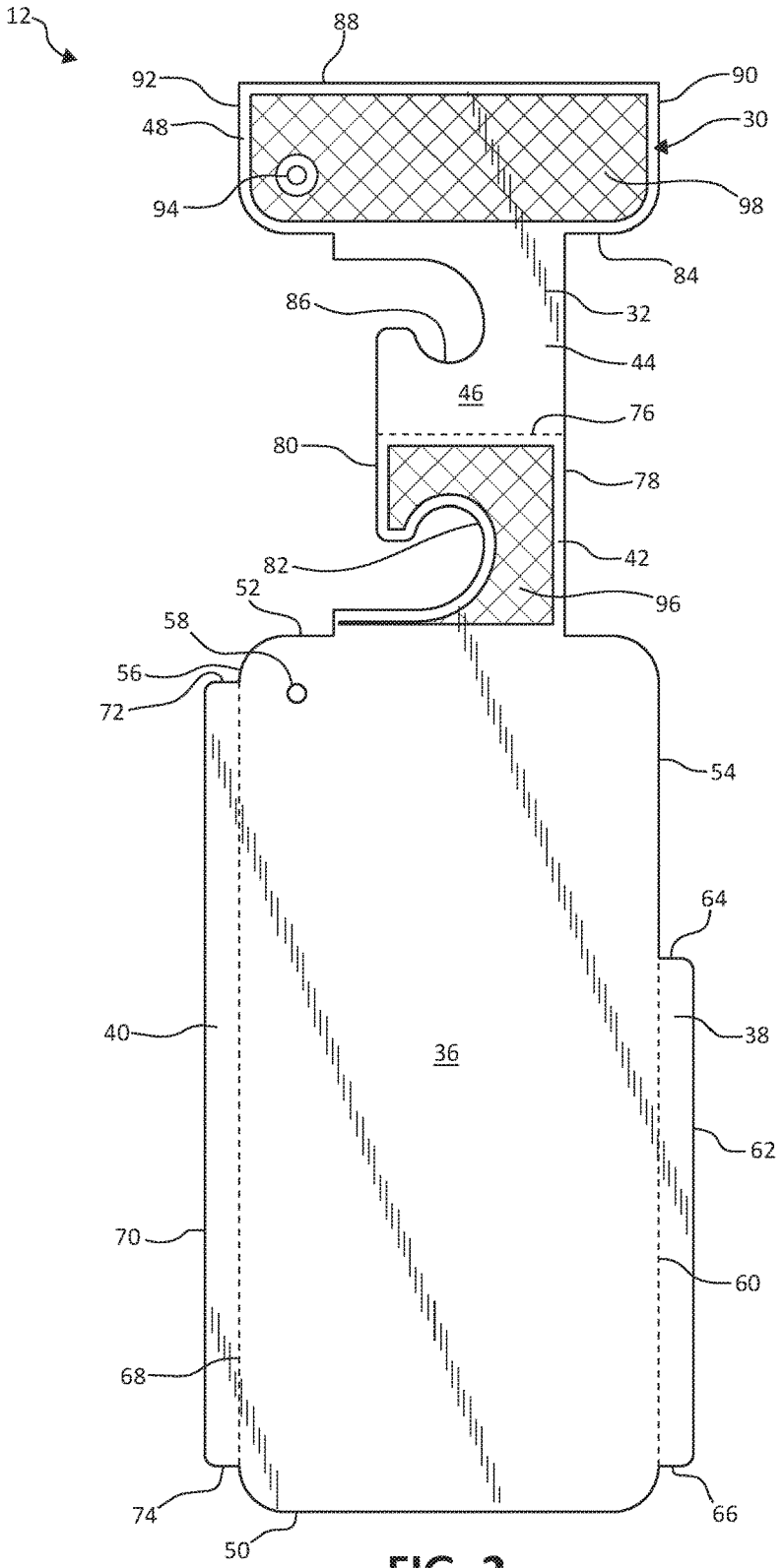
FIG. 2 is a front view of the hang card of FIG. 1 in an unfolded configuration, according to one embodiment of the present invention.
Figure 3:
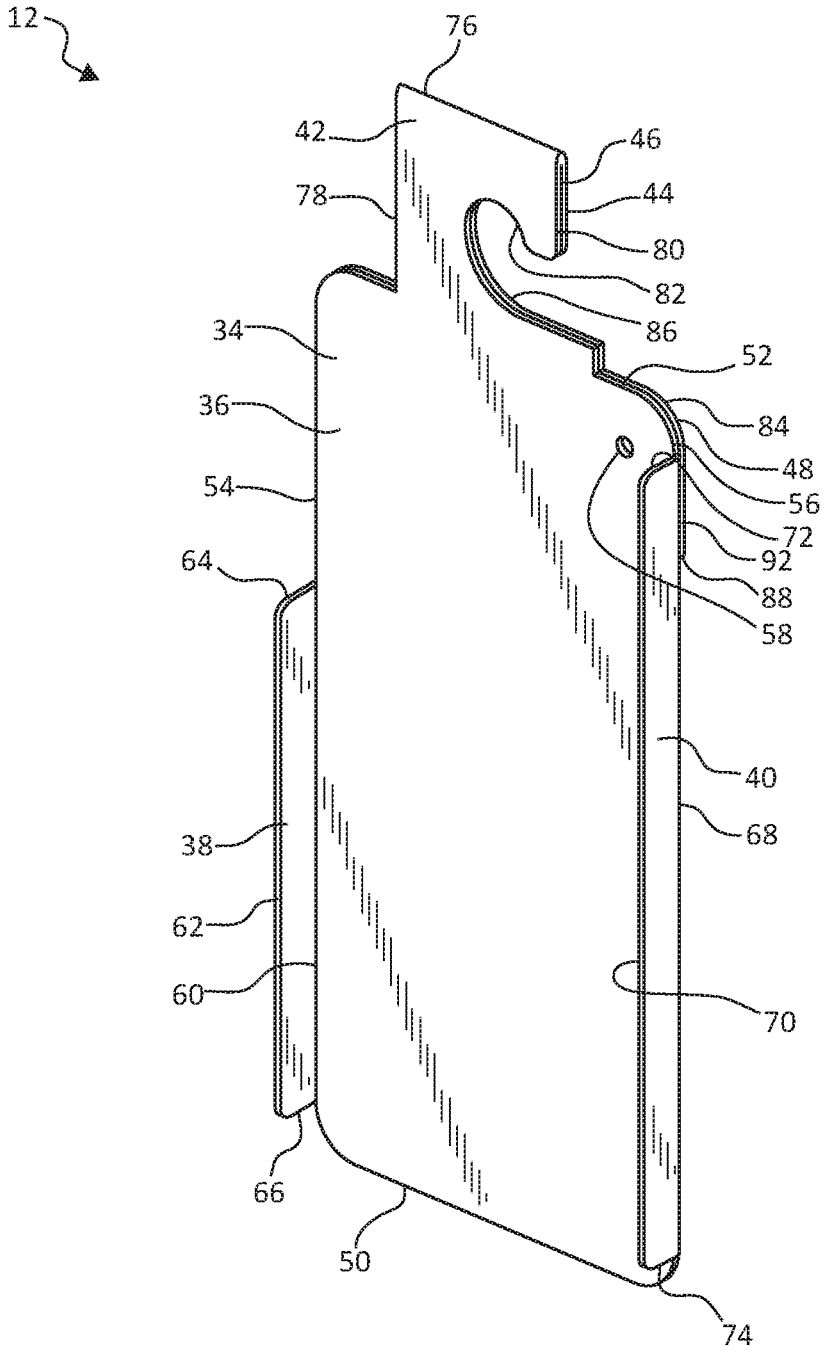
FIG. 3 is a rear perspective view illustration of the hang card of FIG. 2 folded for use supporting a product, according to one embodiment of the present invention.
Figure 5:
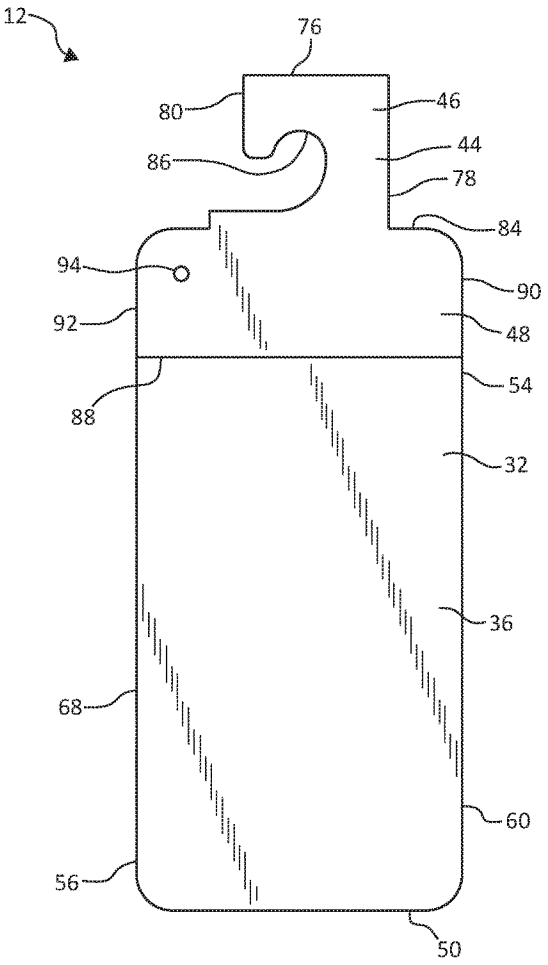
FIG. 5 is a front view illustration of the hang card of FIG. 3, according to one embodiment of the present invention.
Figure 4:
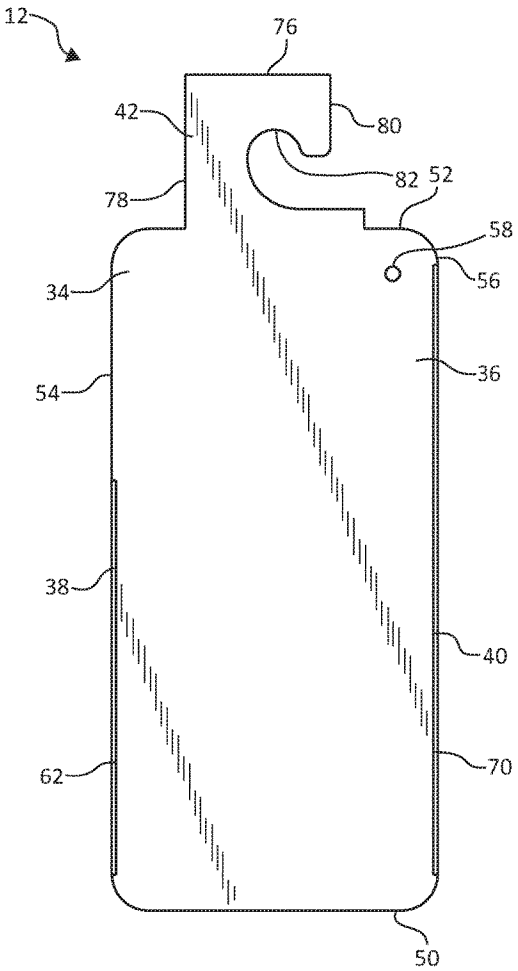
FIG. 4 is a rear view illustration of the hang card of FIG. 3, according to one embodiment of the present invention.
Figure 8:
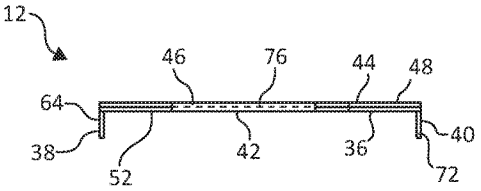
FIG. 8 is a top view illustration of the hang card of FIG. 3, according to one embodiment of the present invention.
Figure 9:
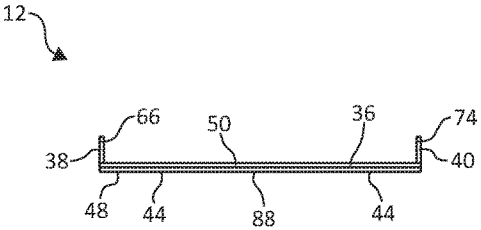
FIG. 9 is a bottom view illustration of the hang card of FIG. 3, according to one embodiment of the present invention.
Figure 7:
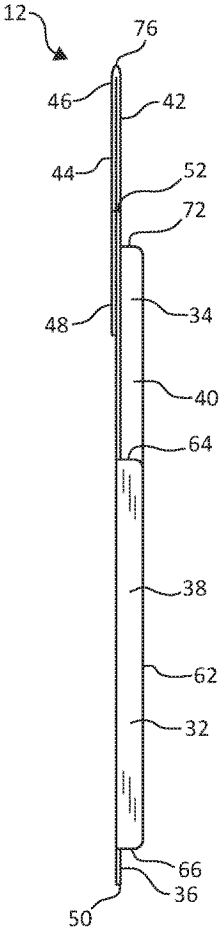
FIG. 7 is a left side view illustration of the hang card of FIG. 3, according to one embodiment of the present invention.
Figure 6:
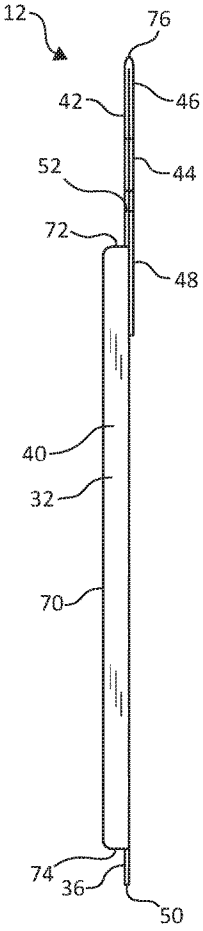
FIG. 6 is a right side view illustration of the hang card of FIG. 3, according to one embodiment of the present invention.

FIG. 2 illustrates hang card 12 as an unfolded blank 30, according to one embodiment of the present invention. Hang card 12, and therefore, blank 30, is formed of a suitable substantially planar material that is sufficiently strong to support mobile device accessory 14, but is able to be folded into the end configuration for receiving that same mobile device accessory 14. In on example, unfolded blank 30 is cut from chipboard, paperboard, cardboard, or a similar material. Hang card 12 when configured as blank 30 defines a first surface 32 (e.g., a front surface), and an opposite second surface 34 (e.g., a rear surface), which are each substantially planar and face away from one another, according to one embodiment of the present invention.

In one embodiment, hang card 12 includes a primary panel 36, a first side panel 38, a second side panel 40, a hook panel 42, and a reinforcement panel 44, where panel is used herein to refer to different portions of blank 30 and, therefore, of hang card 12. Primary panel 36 is sized and shaped just slightly smaller than a footprint of mobile device, and in one example, is substantially rectangular in shape. Primary panel 36 is defined between a bottom edge 50, a top edge 52, a first side edge 54, and a second side edge 56. First and second side edges 54 and 56 extend substantially parallel to one another between bottom edge 50 and top edge 52, which, in one example, are also substantially parallel to one another. In one embodiment, primary panel 36 is substantially solid or continuous between bottom edge 50, top edge 52, first side edge 54, and second side edge 56. In one example, an aperture 58 is formed through primary panel 36, such as in an upper corner thereof corresponding with an opening in mobile device accessory 14, as will be further described below.

A first fold line 60 of hang card 12 is defined along a linear border between primary panel 36 and first side panel 38. First fold line 60 and/or other fold lines described herein may be pre-scored, perforated, or otherwise treated to increase the ease of folding hang card 12 thereabout such fold line. In one example, fold lines as used therein are not pretreated for easier folding. In one embodiment, first fold line 60 is substantially collinear with first side edge 54 of primary panel 36 and extends along a substantially entirety of a height of first side panel 38 such that first side panel 38 can be folded or rotated relative to primary panel 36 about first fold line 60. First side panel 38, more particularly, extends from first fold line 60 away from primary panel 36 to a outside edge 62, which, in one example, is a free edge and extends substantially parallel to first fold line 60. First side panel 38 defines a width between first fold line 60 and outside edge 62 that is substantially equal to a width of a mobile device (not shown) corresponding with the mobile device accessory 14 (see FIG. 1) that hang card 12 is sized to be coupled with during use.

First side panel 38 additionally defines a bottom edge 66 and an opposing top edge 64 each extending between and substantially perpendicularly relative to fold line 60 and outside edge 62. Bottom edge 66 is positioned near bottom edge 50 of primary panel, but in one example, is spaced upwardly therefrom, for example, just above the curvature of an adjacent corner of primary panel 36. Top edge 64 may be similarly near top edge 52, but in one example, as illustrated in FIG. 2, is posited well short of top edge 52 to accommodate openings in mobile device accessory, as will be further described below.

A second fold line 68 of hang card 12 is defined along a linear border between primary panel 36 and second side panel 40. In one embodiment, second fold line 68 is substantially collinear with second side edge 56 of primary panel 36 and extends along a substantial entirety of a height of second side panel 40 such that second side panel 40 can be folded or rotated relative to primary panel 36 about second fold line 68. Second side panel 40, more particularly, extends from second fold line 68 away from primary panel 36 to an outside edge 70, which, in one example, is a free edge and extends substantially parallel to second fold line 68. Second side panel 40 defines a width between second fold line 68 and outside edge 70 that is substantially equal to a width of first side panel 38 and/or to a width of a mobile device (not shown) corresponding with the mobile device accessory 14 (see FIG. 1) that hang card 12 is sized to be coupled with during use.

Second side panel 40 additionally defines a bottom edge 74 and an opposing top edge 72 each extending between and substantially perpendicularly relative to second fold line 68 and outside edge 70. Bottom edge 74 is positioned near bottom edge 50 of primary panel, but in one example, is spaced upwardly therefrom, for example, just above the curvature of an adjacent corner of primary panel 36. Top edge 72 is, in one example, similarly near top edge 52, but in one example, is positioned just below a top corner curvature of primary panel 36.

Hook panel 42 extends upwardly from top edge 52 of primary panel 36 to top fold line 76 such that blank 30 is continuous from primary panel 36 to hook panel 42. In one example, hook panel 42 is centered along top edge 52 between first and second side edges 54 and 56. Hook panel 42 may be of any suitable shape, but in one embodiment, as illustrated in FIG. 2, hook panel 42 is substantially rectangular extending between a first hook side edge 78 and an opposing second hook side edge 80. First hook side edge 78 is inset relative to first side edge 54 of primary panel 36, and second hook side edge 80 is inset relative to second side edge 56 of primary panel 36. In one embodiment, hook panel 42 is slightly larger adjacent primary panel 36 than at other portions thereof to strengthen the overall rigidity of hook panel 42. Hook panel 42 includes a hook cutout 82 partially open to one side, for example, to second hook side edge 80 such that hook cutout 82 is configured to receive support arm 22 or other retail display support as shown in FIG. 1.

Reinforcement panel 44 extends from top fold line 76 away from primary panel 36 to a free edge 88. In one example, reinforcement panel 44 includes a hook-reinforcing panel 46 and a shoulder-reinforcing panel 48. Hook-reinforcing panel 46 is substantially symmetrical with hook panel 42 as considered about top fold line 76, and as such extends between first and second hook side edges 78 and 80 similarly to hook panel 46. Hook-reinforcing panel 46, more specifically, in one example, extends from top fold line 76 to a first shoulder edge 84, which is substantially parallel to and similar in size to top edge 52 of primary panel 36. A hook cutout 86 is formed in hook-reinforcing panel 46 and partially open to second side edge 80 in a symmetrical manner with hook cutout 82 relative to top fold line 76.

Shoulder-reinforcing panel 48 extends from adjacent hook-reinforcing panel 46 along first shoulder edge 84 to free edge 88 to define a height of shoulder-reinforcing panel 48. In one embodiment, the height of shoulder-reinforcing panel 48 is no greater than a height of primary panel 36 between bottom edge 50 and top edge 52 and, in one example, is less than about a quarter of a height of primary panel 36. Shoulder-reinforcing panel 48 defines a width as it extends between a first side edge 90 to a second side edge 92. In one embodiment, first side edge 90 is substantially collinear with first side edge 54 of primary panel 36 and second side edge 92 is substantially collinear with second side edge 56 of primary panel 36. Shoulder-reinforcing panel 48 includes an aperture 94 substantially symmetrical with aperture 58 about top fold line 76.

Hang card 12 is readied for use supporting a mobile device accessory 14 (FIG. 1) by folding reinforcement panel 44 about top fold line 76 and securing a portion of first surface 32 defined by reinforcement panel 44 to a portion of first surface 32 defined by hook panel 42 and primary panel 36. In one example, adhesive 96 or other securement agent is applied to portions of first surface 32 defined by one or both of hook panel 42 and hook-reinforcing panel 46 prior to folding blank 30 about top fold line 76. In one example, adhesive 98 or other securement agent is applied to a portion of first surface 32 defined by one or both of shoulder-reinforcing panel 48 and primary panel 36. With adhesive 96 and/or 98 in place, upon folding of reinforcement panel 44 about top fold line 76 and pressing reinforcement panel 44 to primary panel 36, reinforcement panel 44 is secured to primary panel 44. The double layer of material as well as adhesives 96 and/or 98 reinforce the top of hang card 12 including hook panel 42 and its boundary with primary panel 36 providing a stronger hang card 12 for withstand a large number of hanging and unhanging cycles of use.

Prior to coupling hang card 12 with mobile device accessory 14, first and second side panels 38 and 40 are folded about fold lines 60 and 68, respectively, folding portions of second surface 34 defined by first and second side panels 38 and 40 toward portions of second surface 34 defined by primary panel 36 until each of first and second side panels 38 and 40 extend substantially perpendicularly to primary panel 36. In this manner, in one example, first and second side panels 38 and 40 are folded in an opposite direction of how reinforcement panel 44 is folded relative to primary panel 36. Once side panels 38 and 40 are so positioned, hang card 12 is ready for coupling with mobile device accessory 14.

Figure 10:
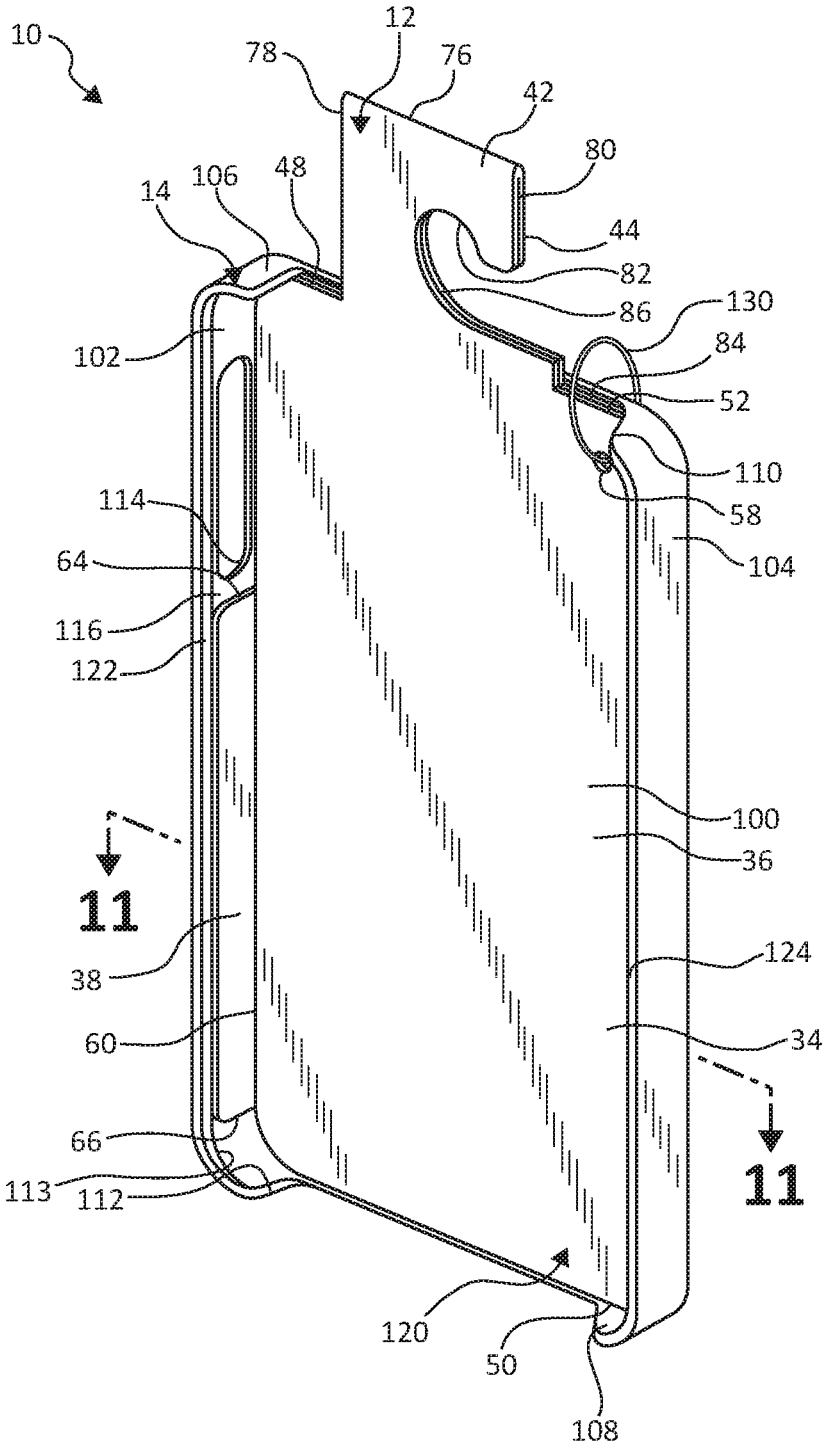
FIG. 10 is a rear perspective view illustration of the hang card coupled to a product for retail sale, according to one embodiment of the present invention.
Figure 11:
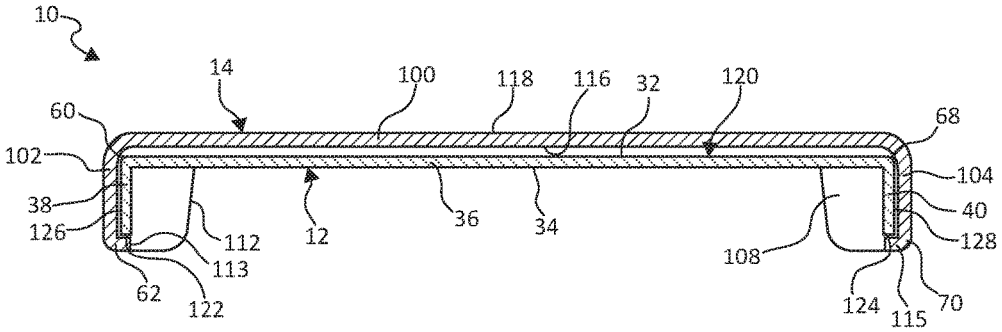
FIG. 11 is a cross-sectional view illustration taken along the line 11-11 in FIG. 10, according to one embodiment of the present invention.

One example of a mobile device accessory 14 is illustrated with reference to FIGS. 1, 10, and 11; however, other mobile device accessories 14 are also contemplated. In one embodiment, mobile device accessory 14 includes a back wall 100, a first sidewall 102, a second sidewall 104, a top wall 106, and a bottom wall 108. Back wall 100 is sized slightly larger to or substantially identically to a mobile device (not shown) that will be maintained by mobile device accessory 14. First and second sidewalls 104 and 106 extend from opposing longitudinal edges of back wall 100 in a first or forward direction with a width just slightly greater than a width of the mobile device sized to fit within mobile device accessory 14. Portions of top wall 106 and/or bottom wall 108 are formed as an extension of first and second sidewalls 104 and 106 to top and bottom edges of back wall 100.

In one example, top wall 106 is discontinuous and has a void or top cutout 110 (e.g., an accessory cutout) in a middle portion thereof. Similarly, in one example, bottom wall 108 is discontinuous and has a void or bottom cutout 112 in a center portion thereof. Top cutout 110 and bottom cutout 112 may be formed to accommodate various features, such as ports, speakers, buttons, etc., on a mobile device (not shown) that mobile device accessory 14 is configured to maintain. In this manner, one or more of first and second sidewalls 102 and 104 including one or more opening 114 also to accommodate, for example, leave uncovered, various features of a corresponding mobile device as will be apparent to those of skill in the art upon reading this application.

Formed as described above, mobile device accessory 14 defines an interior surface 116 and opposite exterior surface 118. Interior surface 116 of mobile device accessory 14 defines a mobile device reception chamber 120 adjacent top interior surface 116 portions defined by each of back wall 100, first sidewall 102, second sidewall 104, top wall 106, and bottom wall 108. Mobile device reception chamber 120 is sized to receive and maintain a corresponding mobile device (not shown) via compression and/or friction fit. To facilitate mobile device coupling, in one example, mobile device accessory 14 includes a first flange 113, which extends along interior surface 116 along a length of first side wall 102 opposite back wall 100, and a second flange 115, which extends along interior surface 116 along a length of second side wall 104 opposite back wall 100. With particular reference to FIG. 11, mobile device accessory 14 includes a first side pocket 126 between back wall 100 and first flange 113 and a second side pocket 128 between back wall 100 and second flange 115. During use of mobile device accessory 14 with a mobile device, edges of mobile device are maintained within first and second side pockets 126 and 128.

Hang card 12 is coupled with mobile device accessory 14 making use of existing features of mobile device accessory 14. For example, hang card 12 is substantially positioned within mobile device reception chamber 120 such that first surface 32 of primary panel 36 faces back wall 100 of mobile device accessory 14, in one embodiment, contacting back wall 100. First and second side panels 38 and 40 are each positioned within a different one of each of first and second side pockets 126 and 127. In this manner outside edge 62 is positioned near first flange 122, and outside edge 70 is positioned near second flange 124. In addition, top edge 52 of primary panel 36 is positioned adjacent and just under top wall 106 of mobile device accessory 14 while bottom edge 50 of primary panel is positioned adjacent and just above bottom wall 108 of mobile device accessory 14. In this manner primary panel 36 is maintained within mobile device reception chamber 120 via first and second pockets 126 and 128 and top and bottom walls 106 and 108 thereof.

Due to top cutout 110 of mobile device accessory 14, hook panel 42, and in one embodiment, hook-reinforcing panel 46 extends through top cutout 110 and above top wall 106 of mobile device accessory 14. More specifically, hook cutouts 82 and 86 are positioned substantially entirely above top wall 106 of mobile device accessory 14 to receive a support arm 22 during display as shown with additional reference to FIG. 1. In this manner, hang card 12 maintains mobile device accessory 14, and all of packaged mobile device accessory 10, hanging below support arm 22 or similar support fixture. In one embodiment, an additional securement device 130 such as a plastic tie is thread through apertures 58 and 94 of hang card 12 and an opening 132, such as an opening to accommodate a back camera in a mobile device, in back panel 100 and around top wall 106 or second side wall 104 an secured to itself. In this manner, additional securement device 130 provides a secondary attachment of use if back primary panel 36 of hang card 12 is otherwise released from mobile device accessory 14.

In view of the above, hang card 12 adds little if any bulk (e.g., substantially no depth or width) to mobile device accessory 14, such that the amount of support arm 22 or other display space needed to support mobile device accessory 14 for retail sale is substantially minimized to the width and depth of mobile device accessory 14 itself. While maintaining the relative slim profile of mobile device accessory 14, second surface 34 of primary panel 36 also provides significant print space for supporting mobile device accessory 14 marketing, identifying, other informative information, and/or processing graphics, such as a bar code, that is readily accessible by a consumer inspecting mobile device accessory 14 and considering the same for purchase.

Figure 12:
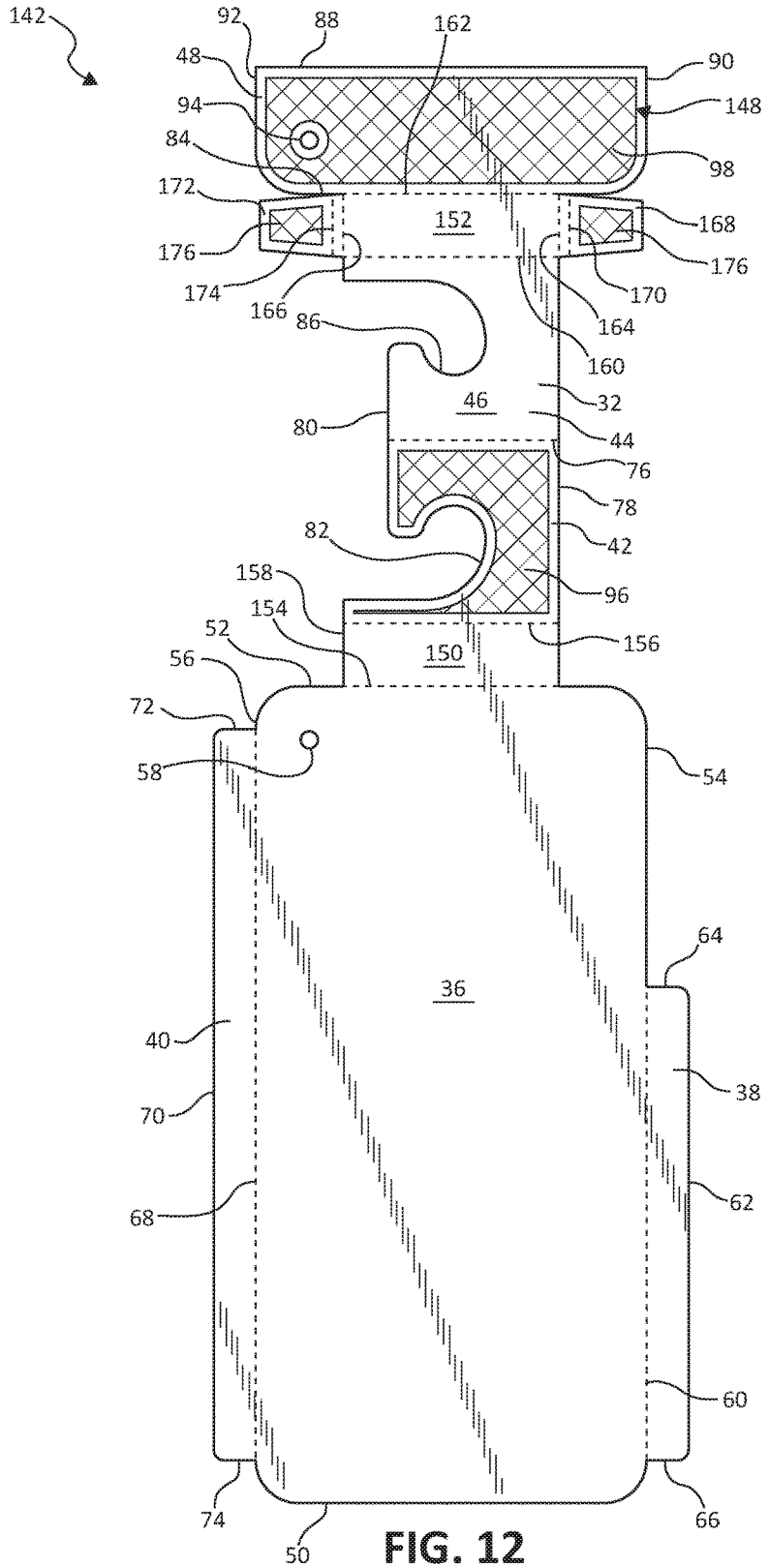
FIG. 12 is a front view of a hang card in an unfolded configuration, according to one embodiment of the present invention.
Figure 13:
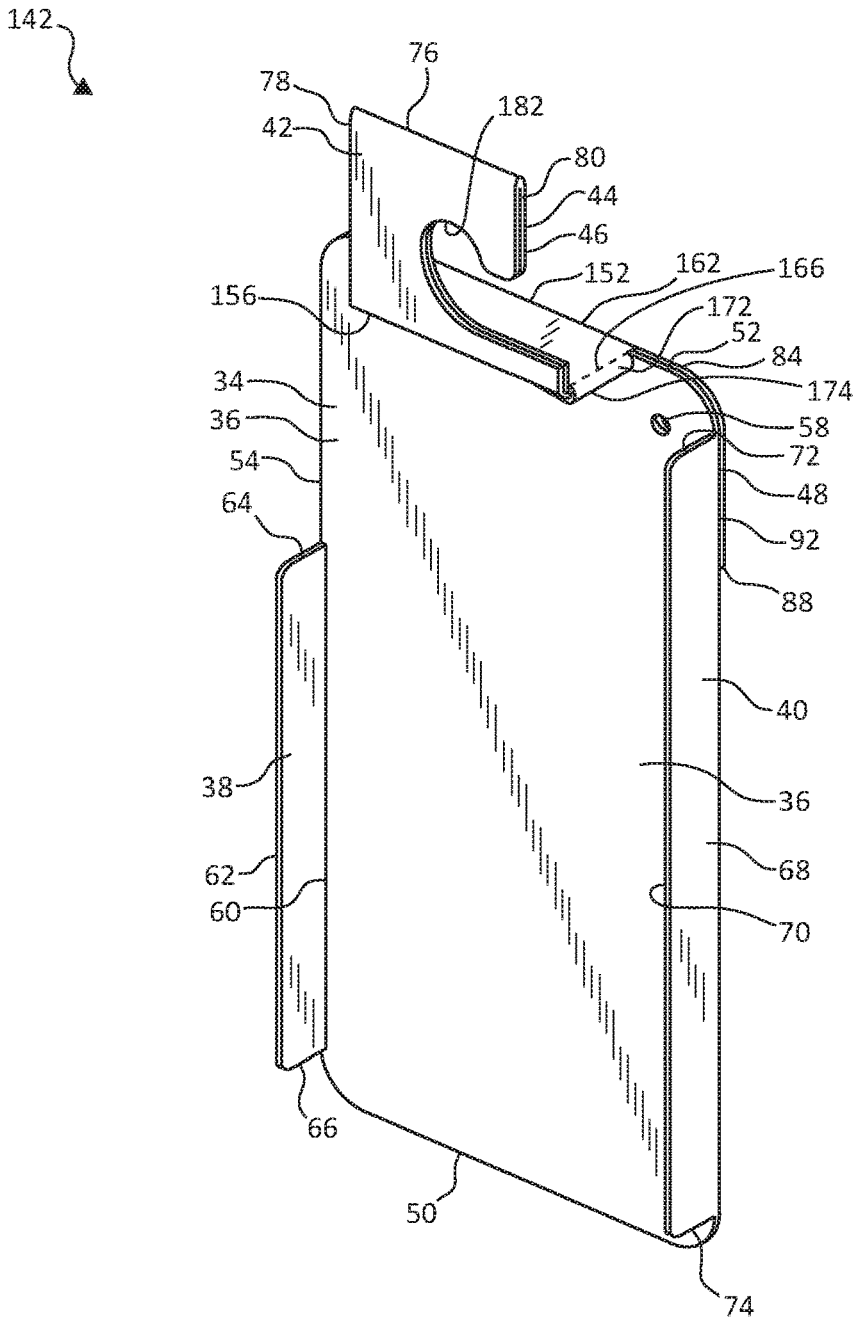
FIG. 13 is a rear perspective view illustration of the hang card of FIG. 12 folded for use supporting a product, according to one embodiment of the present invention.
Figure 15:
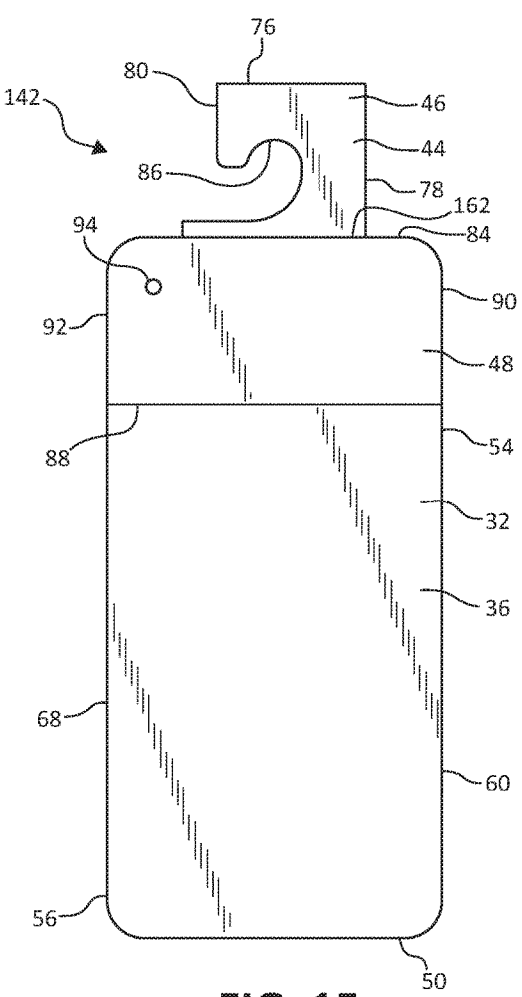
FIG. 15 is a front view illustration of the hang card of FIG. 12, according to one embodiment of the present invention.
Figure 14:
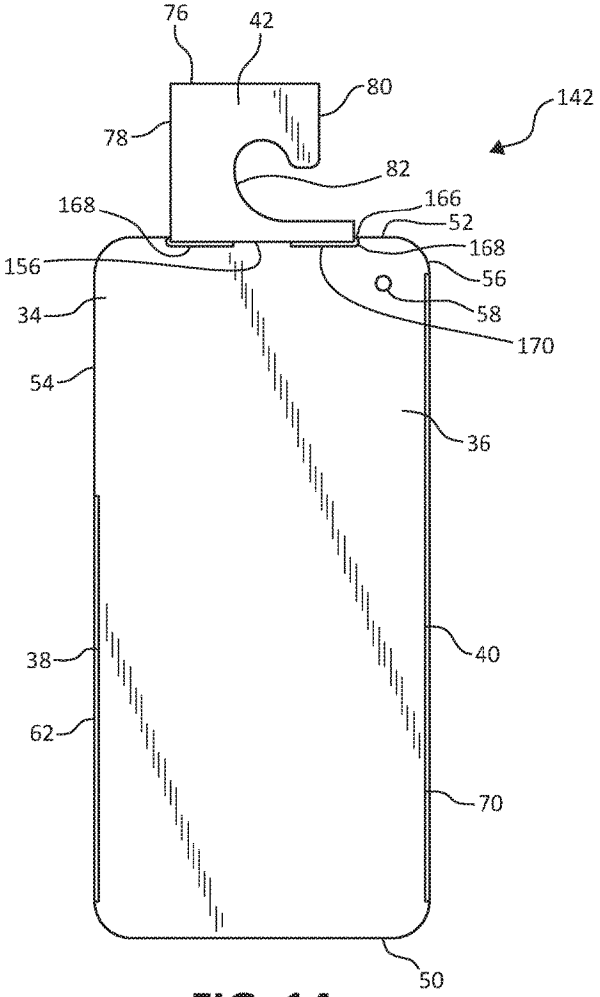
FIG. 14 is a rear view illustration of the hang card of FIG. 12, according to one embodiment of the present invention.
Figure 18:
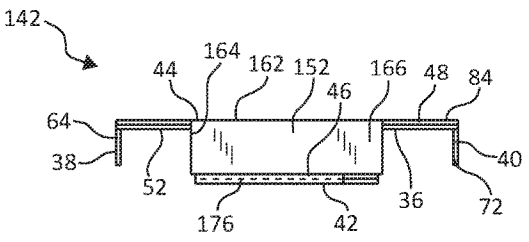
FIG. 18 is a top view illustration of the hang card of FIG. 12, according to one embodiment of the present invention.
Figure 19:
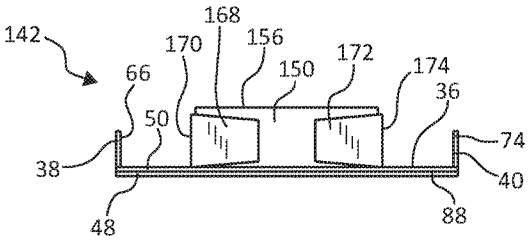
FIG. 19 is a bottom view illustration of the hang card of FIG. 12, according to one embodiment of the present invention.
Figure 17:
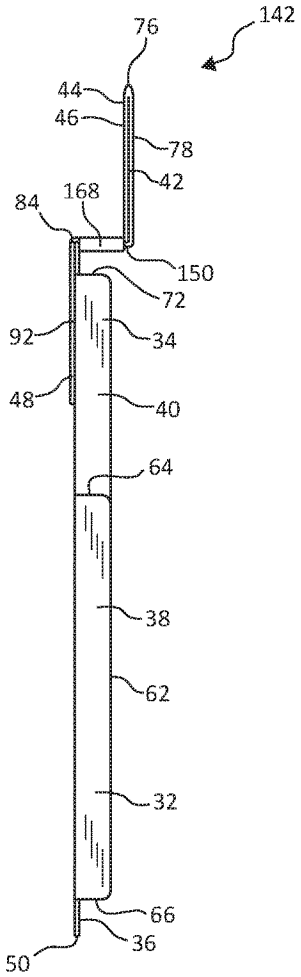
FIG. 17 is a left side view illustration of the hang card of FIG. 12, according to one embodiment of the present invention.
Figure 16:
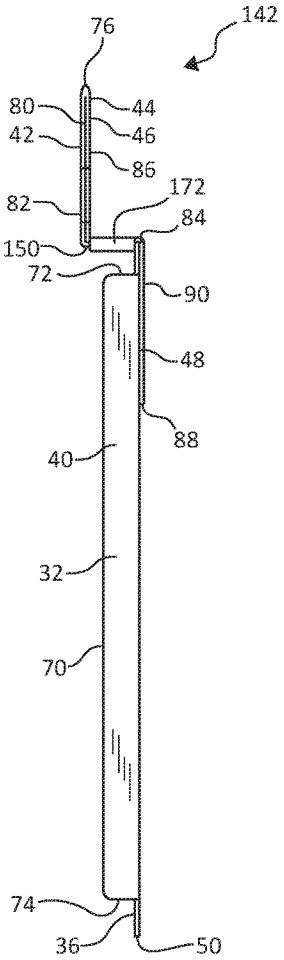
FIG. 16 is a right side view illustration of the hang card of FIG. 12, according to one embodiment of the present invention.

Other embodiments of hang cards are also contemplated. For example, FIGS. 12-19 illustrate another embodiment of a hang card 142. Hang card 142 is largely similar to hang card 12, as evidenced, for example, by similar reference numbers shown in the figures and described herein with differences being described below. Hang card 142 is formed of a planar blank 148 as shown in FIG. 12 and is configured to work with a mobile device accessory 192 (FIG. 20) that differs from mobile device accessory 142 (FIGS. 1 and 10). In one embodiment, hang card 142 additionally includes an offset panel 150 and a corresponding offset-reinforcing panel 152. Offset panel 150 extends from primary panel 36 to hook panel 42 and, in one example, is considered a portion of or an extension of hook panel 42. More specifically, in one example, a first reinforcing fold line 154 extends across a boundary between primary panel 36 and hook panel 42 and is substantially collinear with top edge 52 of primary panel 36. Offset panel 150, in turn, borders hook panel 42 along a second reinforcing fold line 156. In one example, offset panel 150 is sized substantially identically to a lowermost portion of hook panel 42, such that offset panel 150 shares first side edge 78 of hook panel 42 and both offset panel 150 and a bottommost portion of hook panel 42 extend to a second side edge 158 opposite first side edge 78.

Hang card 142 includes offset-reinforcing panel 152, which is substantially symmetrical relative to offset panel 150 about top fold line 76 and extends away from hook-reinforcing panel 46 to shoulder-reinforcing panel 48. In one example, a third reinforcing fold line 160 extends laterally between and borders each of offset-reinforcing panel 152 and hook-reinforcing panel 46, for instance, in a manner substantially parallel to top fold line 76. Hang card 142 additionally defines a fourth reinforcing fold line 162 extending between offset-reinforcing panel 152 and shoulder-reinforcing panel 48, for example, along a substantial entirety of the boundary between offset-reinforcing panel 152 and shoulder-reinforcing panel 48.

In one embodiment, offset-reinforcing panel 152 has a width substantially identical to offset panel 150, and that width is defined between a first longitudinal offset fold line 164 and an opposite, second longitudinal offset fold line 166. First longitudinal offset fold line 164 and second longitudinal offset fold line 166 each extends from third reinforcing fold line 160 and a fourth reinforcing fold line 162. In one embodiment, hang card 142 additionally defines a first coupling tab 168 and a second coupling tab 172 on either lateral side of offset-reinforcing panel 152. More specifically, in the illustrated examples, an interior fold line 170 is formed substantially identically to first longitudinal offset fold line 164, but is laterally outwardly offset therefrom a distance substantially equal to a thickness of the material forming hang card 142.

First coupling tab 168 extends from interior fold line 170 outwardly a distance that, in one example, is less than about half a width of offset-reinforcing panel 152. Similarly, an interior fold line 174 is formed substantially identically to second longitudinal offset fold line 166, but is laterally outwardly offset therefrom a distance substantially equal to a thickness of the material forming hang card 142. Second coupling tab 172 extends from interior fold line 174 outwardly a distance that, in one example, is less than about half a width of offset-reinforcing panel 152, or example, to have a width substantially equal to a width of first coupling tab 168.

Hang card 142 is readied for use supporting a mobile device accessory 192 (FIG. 20) by folding offset panel 150 about first reinforcing fold line 154 toward primary panel 36, folding hook panel 42 in an opposite direction about second reinforcing fold line 156 such that hook panel 42 extends substantially parallel to primary panel 36, rearwardly offset therefrom by offset panel 150. In one example, reinforcement panel 44 of blank 148 is folded about top fold line 76 to position a portion of first surface 32 defined by hook-reinforcing panel 46 to a portion of first surface 32 defined by hook panel 42 and securing the same to one another with, for example, adhesive 96 (FIG. 12) or other securement agent is applied therebetween.

Offset-reinforcing panel 152 is folded about third reinforcing fold line 160 to extend forwardly from hook panel 42 and hook-reinforcing panel 46. For example, when so folded, offset-reinforcing panel 152 extends immediately adjacent to, for example, above, and substantially parallel with offset panel 150. First and second coupling tabs 168 and 172 are folded downwardly about offset-reinforcing panel 152 about first and second longitudinal offset fold lines 164 and 166. Subsequently, first and second coupling tabs 168 and 172 are folded inwardly toward each other about interior fold lines 170 and 174. In one example, adhesive 176 (FIG. 12) or other securement agent is applied to first and second coupling tabs 168 and 172 and/or offset panel 150, such that folding first and second coupling tabs 168 and 172 about interior fold lines 170 and 174 places each of first and second coupling tabs 168 and 172 adjacent a bottom surface (i.e., a portion of second surface 34) of offset panel 150 with adhesive 176 therebetween. Pressure is applied pushing first and second coupling tabs 168 and 172 tightly against offset panel 150 securing first and second coupling tabs 168 and 172 to offset panel 150. In this manner offset panel 150 is reinforced via offset-reinforcing panel 152, first and second coupling tabs 168 and 172, and/or adhesive 176.

In one example, adhesive 98 or other securement agent is applied to a portion of first surface 32 defined by one or both of shoulder-reinforcing panel 48 and primary panel 36. With adhesive 96 and/or 98 in place, reinforcement panel 44 is folded downwardly about top fold line 76 placing portions of first surface 32 of primary panel 36 and reinforcement panel 44 adjacent one another other than adhesive 98 being interposed therebetween. Pressure is applied pushing reinforcement panel 44 tightly against primary panel 36, thereby securing reinforcement panel 44 to primary panel 44 via adhesive 98, in one example. The double layers of material as well as adhesives 96, 98, and/or 176 reinforce the top of hang card 142 including hook panel 42, offset panel 150, offset-reinforcing panel 152 and folded boundaries therebetween providing a stronger hang card 12 for withstand a large number of hanging and unhanging cycles of use.

Prior to coupling hang card 12 with mobile device accessory 14, first and second side panels 38 and 40 are folded about fold lines 60 and 68, respectively, folding portions of second surface 34 defined by first and second side panels 38 and 40 toward portions of second surface 34 defined by primary panel 36 until each of first and second side panels 38 and 40 extend substantially perpendicularly to primary panel 36. In this manner, in one example, first and second side panels 38 and 40 are folded in an opposite direction of how reinforcement panel 44 is folded relative to primary panel 36, but in the same direction offset panel 150 is folded relative to primary panel 36. Once side panels 38 and 40 are so positioned, hang card 12 is ready for coupling with mobile device accessory 14 as illustrated in FIGS. 13-19.

Figure 20:
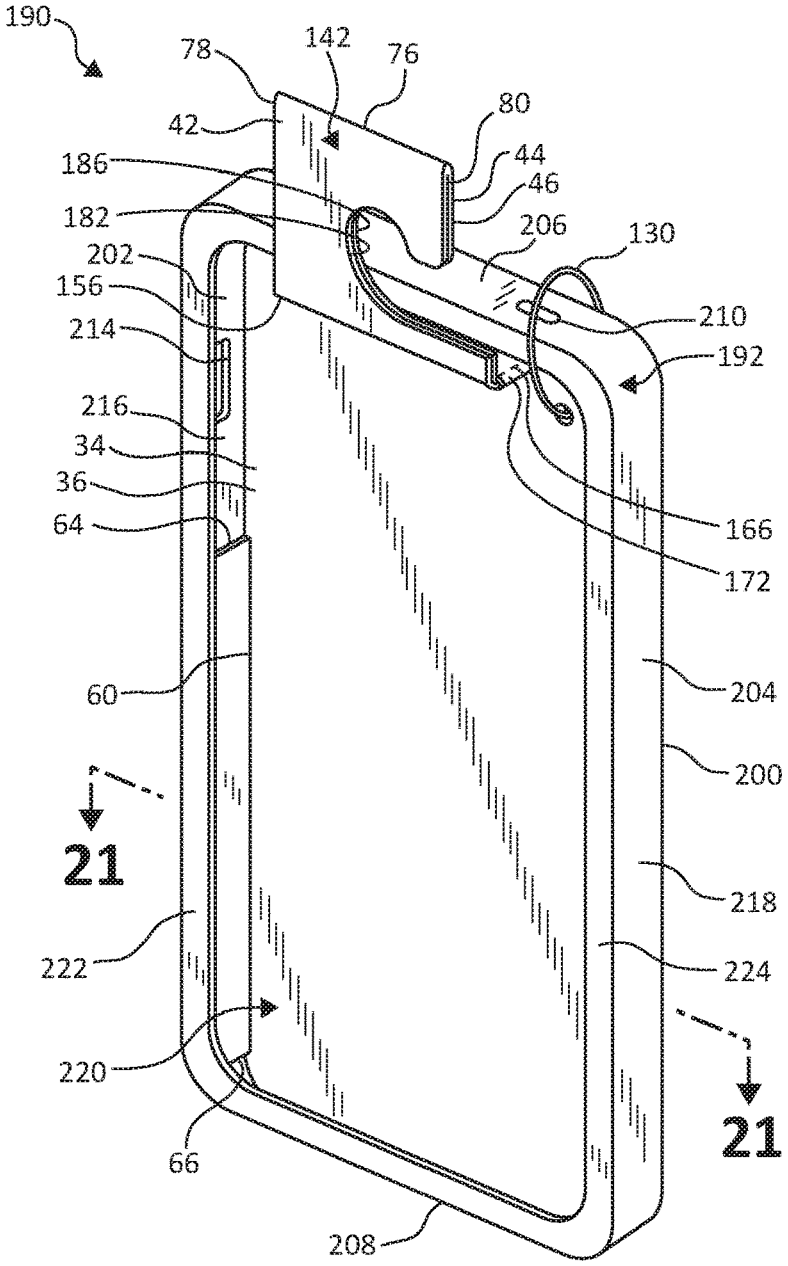
FIG. 20 is a rear perspective view illustration of the hang card of FIG. 12 coupled to a product for retail sale, according to one embodiment of the present invention.
Figure 21:
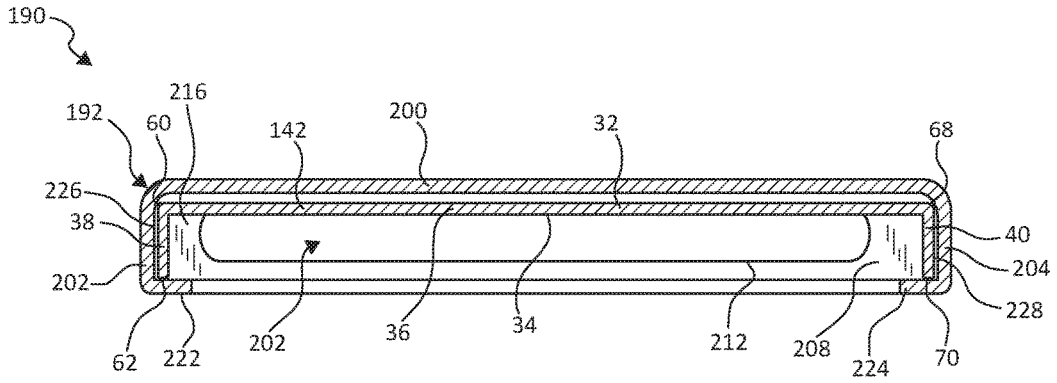
FIG. 21 is a cross-sectional view illustration taken along the line 21-21 in FIG. 20, according to one embodiment of the present invention.

One example of a mobile device accessory 192 is illustrated with reference to FIGS. 20 and 21. In one embodiment, mobile device accessory 192 includes a back wall 200, a first sidewall 202, a second sidewall 204, a top wall 206, and a bottom wall 208. Back wall 200 is sized slightly larger to or substantially identically to a mobile device (not shown) that will be maintained by mobile device accessory 192. First and second sidewalls 204 and 206 extend from opposing longitudinal edges of back wall 200 in a first or forward direction with a width just slightly greater than a width of the mobile device sized to fit within mobile device accessory 192. Portions of top wall 206 and/or bottom wall 208 are formed as an extension of first and second sidewalls 204 and 206 to top and bottom edges of back wall 200.

In one example, top wall 206 includes a top button feature 210 for facilitating user access to a button on mobile device (not shown) that will eventually be maintained by mobile device accessory 192. In one example, bottom wall 208 includes a bottom wall opening 212 (see FIG. 21) in a center portion thereof and/or first side wall 202 includes an side wall opening 214, each configured to accommodate any one or more of a variety of features, such as ports, speakers, buttons, etc., on the mobile device that will eventually be maintained by mobile device accessory 192.

Formed as described above, mobile device accessory 192 defines an interior surface 216 and opposite exterior surface 218. Interior surface 216 of mobile device accessory 192 defines a mobile device reception chamber 220 adjacent top interior surface 216 portions defined by each of back wall 200, first sidewall 202, second sidewall 204, top wall 206, and bottom wall 208. Mobile device reception chamber 220 is sized to receive and maintain a corresponding mobile device (not shown) via compression and/or friction fit. To facilitate mobile device coupling, in one example, mobile device accessory 192 includes a first flange 222, which extends from an edge of first side wall 202 opposite back wall 200 over mobile device reception chamber 220, and a second flange 224, which from an edge second side wall 204 opposite back wall 200 over mobile device reception chamber 220. With particular reference to FIG. 21, mobile device accessory 192 includes a first side pocket 226 between back wall 200 and first flange 212 and a second side pocket 228 between back wall 200 and second flange 214. During use of mobile device accessory 192 with a mobile device, edges of mobile device are maintained within first and second side pockets 226 and 228.

Hang card 142 is coupled with mobile device accessory 192 making use of existing features of mobile device accessory 192 to collectively form packaged mobile phone accessory 190. For example, hang card 142 is substantially positioned within mobile device reception chamber 220 such that first surface 32 of primary panel 36 faces back wall 200 of mobile device accessory 192, in one embodiment, contacting back wall 200. First and second side panels 38 and 40 are each positioned within a different one of each of first and second side pockets 226 and 227. In this manner, outside edge 62 is positioned near first flange 222, and outside edge 70 is positioned near second flange 224. In addition, top edge 52 of primary panel 36 of hang card 12 is positioned adjacent and just under top wall 206 of mobile device accessory 192 while bottom edge 50 of primary panel 36 of hang card 12 is positioned adjacent and just above bottom wall 208 of mobile device accessory 192. Accordingly, primary panel 36 of hang card 142 is maintained within mobile device reception chamber 220 via first and second pockets 226 and 228 and top and bottom walls 206 and 208 thereof.

Mobile device accessory 192 has a more continuous extension of top wall 206 as compared to mobile device accessory 14, which hang card 142 is configured to accommodate. In particular, offset panel 150 and offset-reinforcing panel 152 fit under top wall 206 extending substantially parallel therewith, in one example, spacing hook panel 42 and hook-reinforcing panel 46 away from primary panel 36. More specifically, hook panel 42 and hook-reinforcing panel 46 collectively extend on the front side of top wall 206 in a manner allowing hook panel 42 and hook-reinforcing panel 46 to extend upwardly beyond top wall 206 for receiving a support arm 22 (e.g., FIG. 1) or other suitable supporting structure during retail display. In this manner, hang card 142 maintains mobile device accessory 192 hanging below support arm 22 or similar support fixture. In one embodiment, as shown in FIG. 20, an additional securement device 130 such as a plastic tie is thread through apertures 58 and 94 of hang card 192 and an opening (not shown) in back panel 200 and around top wall 206 or second side wall 204 an secured to itself. In this manner, additional securement device 130 provides a secondary attachment of use if back primary panel 36 of hang card 142 is otherwise released from mobile device accessory 192.

In view of the above, hang card 142, like hang card 12, adds little if any bulk (e.g., no depth or width) to mobile device accessory 192, such that the amount of space along support arm 22 or other display space needed to support packaged mobile device accessory 190 for retail sale is substantially minimized to the width and depth of mobile device accessory 192 itself. While maintaining the relative slim profile of mobile device accessory 192, second surface 34 of primary panel 36 also provides significant print space for supporting mobile device accessory 192 marketing, identifying, other informative information, and/or processing graphics, such as a bar code, that is readily accessible by a consumer inspecting mobile device accessory 14 and considering the same for purchase.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A packaged mobile device accessory comprising:

a mobile device accessory including a back wall, a top wall, at least two opposing sidewalls, and first and second flanges, wherein each of the first and second flanges extends from one of the at least two opposing sidewalls opposite the back wall to form a corresponding one of a first side pocket and a second side pocket therebetween; and a hang card including:

a primary panel positioned adjacent the back wall and defining two opposing side edges and a top edge, two card sidewalls each extending from a different one of the two opposing side edges of the primary panel, each of the two card sidewalls being maintained within a different one of the first side pocket and the second side pocket of the mobile device accessory, and a hook panel extending upwardly away from the top edge of the primary panel and above the top wall of the mobile device accessory, the hook panel including a hook cutout configured to receive a supporting structure above the top wall of the mobile device accessory such that the packaged mobile device is configured to hang from the supporting structure.

2. The packaged mobile device accessory of claim 1, wherein:

the hang card includes a hook-reinforcing panel bordering the hook panel opposite the primary panel along a top fold line, the hook-reinforcing panel is substantially symmetrical with the hook panel about the top fold line, and the hook-reinforcing panel is folded about the top fold line and secured to the hook panel to reinforce the hook panel.

3. The packaged mobile device accessory of claim 2, wherein:

the hang card includes a shoulder-reinforcing panel extending from the hook-reinforcing panel opposite the top fold line, and the shoulder-reinforcing panel extends substantially parallel to and is secured to a top portion of the primary panel of the hang card to reinforce the hang card.

4. The packaged mobile device accessory of claim 3, wherein:

the primary panel and the shoulder-reinforcing panel each define an aperture therethrough, and the packaged mobile device includes a securement device thread through each of the apertures in the primary panel and the reinforcing shoulder and a hole in the back panel of the mobile device accessory and being coupled to itself to further secure the hang card to the mobile device accessory.

5. The packaged mobile device accessory of claim 1, wherein the hang card is formed of a single piece of a substantially planar material.

6. The packaged mobile device accessory of claim 1, wherein each of the two card sidewalls each extends forwardly substantially perpendicularly relative to the primary panel in a manner substantially parallel to the at least two opposing sidewalls of the mobile device accessory.

7. The packaged mobile device accessory of claim 6, wherein:

each of the two card sidewalls extends a substantially identical distance forward from the primary panel, and the substantially identical distance is substantially equal to a depth of each of the first side pocket and the second side pocket between the back wall and the corresponding one of the first flange and the second flange.

8. The packaged mobile device accessory of claim 1, wherein:

mobile device accessory defines an internal chamber including the first and second side pockets configured to receive a mobile device, and the primary panel is substantially identically sized and shaped as the internal chamber.

9. The packaged mobile device accessory of claim 1, wherein:

the top wall of the mobile device accessory includes an accessory cutout, and the hook panel of the hang card extends through the accessory cutout and above the top wall of the mobile device accessory.

10. The packaged mobile device accessory of claim 1, wherein:

the hang card includes an offset panel extending from the top edge of the primary panel to the hook panel, and the offset panel extending substantially perpendicularly relative to each of the back wall and the hook panel to offset the hook panel from the back wall.

11. The packaged mobile device accessory of claim 10, wherein a distance the hook panel is offset from the back wall via the offset panel is at least equal to a depth the top wall extends away from the back wall.

12. The packaged mobile device accessory of claim 11, wherein:

the hang card includes a hook-reinforcing panel bordering the hook panel opposite the primary panel along a top fold line, the hook-reinforcing panel is substantially symmetrical with the hook panel about the top fold line, and the hook-reinforcing panel is folded about the top fold line and secured to the hook panel to reinforce the hook panel.

13. The packaged mobile device accessory of claim 12, wherein:

the hang card includes an offset reinforcing panel bordering the hook-reinforcing panel along an offset fold line and extending away from the hook-reinforcing panel in a direction opposite the top fold line, and the offset reinforcing panel being folded about the offset fold line to extend substantially parallel with and be secured to the offset panel.

14. The packaged mobile device accessory of claim 13, wherein the offset reinforcing panel is secured to the offset panel via tabs fold down from sides of the offset reinforcing panel and adhered to a surface of the offset panel opposite the offset reinforcing panel.

15. The packaged mobile device accessory of claim 13, wherein:

the hang card includes a shoulder-reinforcing panel extending from the hook-reinforcing panel opposite the top fold line, and the shoulder-reinforcing panel extends substantially parallel to and is secured to a top portion of the primary panel of the hang card to reinforce the hang card.

16. A packaged product comprising:

a mobile device accessory including a back wall, a top wall, at least two opposing sidewalls, and first and second flanges, wherein each of the first and second flanges extends from one of the at least two opposing sidewalls opposite the back wall to form a corresponding one of a first side pocket and a second side pocket therebetween; and a hang card for suspending the mobile device accessory from a support, the hang card comprising:

a primary panel defining two opposing side edges and a top edge, two card sidewalls each extending from a different one of the two opposing side edges of the primary panel substantially perpendicularly relative to the primary panel, and a hook panel extending upwardly from the top edge of the primary panel, the hook panel including a hook cutout configured to receive a supporting structure.

17. The packaged product of claim 16, wherein the primary panel is sized and shaped substantially identically to the primary panel of the mobile device accessory between the at least two opposing sidewalls, and the primary panel is configured to fit between the at least two opposing sidewalls adjacent the back wall.

18. The packaged product of claim 16, wherein:

each of the two card sidewalls extends from the primary panel a substantially identical distance, and each of the two card sidewalls is configured to be tightly maintained between the back wall and a one of the first and second flanges within a different one of the side pockets to at least partially coupled the hang card with the mobile device accessory.

19. The packaged product of claim 16, wherein the hang card includes:

a hook-reinforcing panel bordering the hook panel opposite the primary panel along a top fold line, the hook-reinforcing panel being substantially symmetrical with the hook panel about the top fold line, and the hook-reinforcing panel being folded about the top fold line and secured to the hook panel to reinforce the hook panel, and a shoulder-reinforcing panel extending from the hook-reinforcing panel opposite the top fold line, the shoulder-reinforcing panel extending substantially parallel to and being secured to a top portion of the primary panel of the hang card to reinforce the hang card.

20. The packaged product of claim 16, wherein the hang card includes:

an offset panel extending from the top edge of the primary panel to the hook panel, the offset panel extending substantially perpendicularly relative to each of the back wall and the hook panel to offset the hook panel from the back wall.

* * * * *